US010738264B2

(12) United States Patent
Bergström et al.

(10) Patent No.: US 10,738,264 B2
(45) Date of Patent: Aug. 11, 2020

(54) METHOD FOR PURIFICATION OF ANIMAL OR VEGETABLE FATS

(71) Applicant: Neste Oyj, Espoo (FI)

(72) Inventors: Pia Bergström, Porvoo (FI); Blanka Toukoniitty, Espoo (FI); Annika Malm, Espoo (FI); Mervi Waddilove, Espoo (FI)

(73) Assignee: NESTE OYJ, Espoo (FI)

( * ) Notice: Subject to any disclaimer, the term of this patent is extended or adjusted under 35 U.S.C. 154(b) by 0 days.

(21) Appl. No.: 16/337,744

(22) PCT Filed: Sep. 28, 2017

(86) PCT No.: PCT/EP2017/074611
§ 371 (c)(1),
(2) Date: Mar. 28, 2019

(87) PCT Pub. No.: WO2018/060324
PCT Pub. Date: Apr. 5, 2018

(65) Prior Publication Data

US 2019/0345409 A1 Nov. 14, 2019

(30) Foreign Application Priority Data

Sep. 30, 2016 (FI) ..... 20165735

(51) Int. Cl.

| | |
|---|---|
| ***C11B 3/16*** | (2006.01) |
| ***C11B 3/00*** | (2006.01) |
| ***C11B 13/00*** | (2006.01) |
| ***C11C 1/00*** | (2006.01) |

(52) U.S. Cl.
CPC ..... *C11B 3/16* (2013.01); *C11B 3/006* (2013.01); *C11B 13/005* (2013.01); *C11C 1/007* (2013.01)

(58) Field of Classification Search
CPC ..... C11B 3/16; C11B 3/006; C11B 13/005; C11C 1/007
USPC ..... 554/175
See application file for complete search history.

(56) References Cited

U.S. PATENT DOCUMENTS

| | | | |
|---|---|---|---|
| 2,182,755 | A | 12/1939 | Benjamin et al. |
| 2,601,375 | A | 6/1952 | Durkee |
| 2,657,224 | A | 10/1953 | Bierke |
| 2,728,714 | A | 12/1955 | Winkler et al. |
| 3,758,533 | A | 9/1973 | Lee |
| 3,984,447 | A | 10/1976 | Cooper et al. |
| 4,033,859 | A | 7/1977 | Davidson et al. |

(Continued)

FOREIGN PATENT DOCUMENTS

| | | | |
|---|---|---|---|
| CN | 103224836 | A | 7/2013 |
| CN | 104479863 | A | 4/2015 |

(Continued)

OTHER PUBLICATIONS

International Preliminary Report on Patentability (PCT/IPEA/416) dated Jan. 3, 2019, issued in corresponding International Patent Application No. PCT/EP2017/074578. (6 pages).

(Continued)

*Primary Examiner* — Deborah D Carr
(74) *Attorney, Agent, or Firm* — Buchanan Ingersoll & Rooney PC

(57) ABSTRACT

Present invention relates to a novel process for purification of lipid material for further use as such as e.g. a source of fuel or chemicals.

18 Claims, 8 Drawing Sheets

(56) References Cited

U.S. PATENT DOCUMENTS

| | | | | |
|---|---|---|---|---|
| 4,865,978 | A | 9/1989 | Serota | |
| 5,306,419 | A | 4/1994 | Harrison et al. | |
| 5,676,840 | A | 10/1997 | Paul | |
| 7,262,311 | B2 * | 8/2007 | Christianson | A23D 9/00 554/175 |
| 2009/0266743 | A1 | 10/2009 | Yao et al. | |
| 2011/0047866 | A1 | 3/2011 | Bao et al. | |
| 2011/0077436 | A1 | 3/2011 | Yao et al. | |
| 2011/0184201 | A1 | 7/2011 | Mcneff | |
| 2013/0345457 | A1 | 12/2013 | Mcneff | |
| 2014/0087042 | A1 | 3/2014 | Gordon et al. | |
| 2016/0060565 | A1 | 3/2016 | Perez et al. | |

FOREIGN PATENT DOCUMENTS

| | | | |
|---|---|---|---|
| DE | 102011055559 | A1 | 5/2013 |
| EP | 0195991 | A2 | 10/1986 |
| FI | 96964 | C | 9/1996 |
| GB | 1065051 | A | 4/1967 |
| GB | 1470022 | A | 4/1977 |
| GB | 1510056 | A | 5/1978 |
| GB | 2412664 | A | 10/2005 |
| NL | 7205618 | A | 10/1973 |
| WO | 2010010364 | A2 | 1/2010 |
| WO | 2013006578 | A1 | 1/2013 |
| WO | 2014058294 | A1 | 4/2014 |
| WO | 2014081279 | A1 | 5/2014 |

OTHER PUBLICATIONS

International Search Report and Written Opinion dated Dec. 1, 2017, issued in corresponding International Patent Application No. PCT/EP2017/074578. (9 pages).

D. Rade, et al., "Effect of Soybean Pretreatment on the Phospholipid Content in Crude and Degummed Oils," FETT—Lipid.Fat Science Technology, Wiley-VCH Verlag, Weinheim, DE, vol. 97, Jan. 1, 1995, pp. 501-507.

Search Report issued in corresponding Finnish Patent Application No. 20165734, 2 pages (dated Jan. 30, 2017).

International Preliminary Report on Patentability (PCT/IPEA/409) dated Jan. 30, 2019 by the European Patent office as the International Searching Authority for International Application No. PCT/EP2017/074583. (15 pages).

International Search Report (PCT/ISA/210) dated Feb. 5, 2018, by the European Patent Office as the International Searching Authority for International Application No. PCT/EP2017/074583. (3 pages).

Written Opinion (PCT/ISA/237) dated Feb. 5, 2018, by the European Patent Office as the International Searching Authority for International Application No. PCT/EP2017/074583. (7 pages).

Written Opinion of the International Preliminary Examining Authority (PCT/IPEA/408) dated Aug. 20, 2018, by the European Patent Office as the International Searching Authority for International Application No. PCT/EP2017/074583. (4 pages).

U.S. Appl. No. 16/337,726, "Oil Purification Process" by Annika Malm, et al., filed Mar. 28, 2019.

U.S. Appl. No. 16/337,717, "Water Treatment of Lipid Material" by Blanka Toukoniitty, et al., filed Mar. 28, 2019.

Finnish Search Report for Finnish Patent Application No. 20165735 dated Jan. 30, 2017 (2 pages).

International Preliminary Report on Patentability (PCT/IPEA/409) dated Sep. 19, 2018, by the European Patent Office as the International Searching Authority for International Application No. PCT/EP2017/074611.

International Search Report (PCT/ISA/210) dated Jan. 2, 2018, by the European Patent Office as the International Searching Authority for International Application No. PCT/EP2017/074611.

Written Opinion (PCT/ISA/237) date Jan. 2, 2018, by the European Patent Office as the International Searching Authority for International Application No. PCT/EP2017/074611.

* cited by examiner

METHOD FOR PURIFICATION OF ANIMAL OR VEGETABLE FATS

TECHNICAL FIELD

Present invention relates to methods for purification of lipid materials, especially lipid materials originating from biological material. The method enables removal of impurities from the lipid material. In particular, the invention relates to methods for purifying lipid materials conventionally seen as containing levels of impurities too high to be commercially profitable to use in a purification process to obtain a purified feedstock of a quality allowing the use thereof as a source of fuel or chemicals. The impurities may be of a character that conventional methods are not able to remove from the feedstock to such a degree that is prescribed as the appropriate quality for further use as a source of fuel or chemicals.

BACKGROUND ART

U.S. Pat. No. 3,758,533 relates to a method for removing polyethylene impurities from tallow and like fatty materials. In the method, the fatty material is heated to a temperature to about 95° C. or below but above the melting temperature of the fatty material to render the polymeric impurities insoluble in the fatty material and separating the impurities. The separation of impurities can be conducted by filtration or centrifuging. According to the teachings of U.S. Pat. No. 3,758,533 separation of polyethylene impurities by settling is not possible since the density of polyethylene is only a little greater than that of tallow (866 kg/m$^3$).

U.S. Pat. No. 7,262,311 relates to a method for removing phospholipids and other impurities from crude vegetable oil using physical refining techniques. In the method, the crude oil is allowed to settle over a period of time, such as 20 days, such that the oil separates into a gums layer and oil layer which are separated from each other. The purified oil contains from 25 ppm to 110 ppm of phosphorus.

U.S. Pat. No. 2,601,375 relates to a method for recovering of vegetable oils from sludge or settlings, which accumulate in vegetable oil storage tanks. In the method, the sludge is mixed and heated with water and the mixture is allowed to cool and settle into an upper oil phase and lower aqueous phase with solid impurities. The separated lower phase can be treated with alkali followed by acid treatment.

SUMMARY OF THE INVENTION

Present invention provides for an efficient method of purification of lipid material. The lipid material is specifically originating from biological origin.

Consequently, present invention relates to a method for purifying lipid material, characterized in that the method comprises the following steps;

a) storing the lipid material in a settling tank at elevated temperature, b) allowing the impurities to settle to the bottom of the settling tank to thereby form an oily sludge phase, c) separating the formed oily sludge phase from the rest of the lipid material, d) further processing the lipid material e) optionally purifying said separated oily sludge phase from impurities, and optionally f) returning the purified oil from the purifying step e) to said settling tank.

In present invention the term "lipid material" should be understood as meaning any material having a biological origin. Specifically the term may thus denote tall oil pitch or the residual bottom fraction from tall oil distillation processes, animal based oils or fats, fish based oils or fats, vegetable based oils or fats such as e.g. sludge palm oil and used cooking oil or oil used in deep frying, microbial or algae oils. Other examples are e.g. plant oils, plant fats, animal fats and animal oils, and mold oils. Specifically, the term may comprise rapeseed oil, canola oil, colza oil, tall oil, sunflower oil, soybean oil, hemp oil, olive oil, linseed oil, cottonseed oil, mustard oil, palm oil, arachis oil, castor oil, coconut oil, animal fats such as suet, tallow, blubber, recycled alimentary fats, starting materials produced by genetic engineering, and biological starting materials produced by microbes such as algae and bacteria. It is to be understood that the term may comprise a mixture of any of the above mentioned examples.

The lipid material used in the process may also be fossil based, such as e.g. various oils used and produced by the oil industry. Non-limiting examples are various petroleum products such as e.g. fuel oils and gasoline (petrol). The term also encompasses all used products in either the refining process or e.g. used lubrication oils, waste plastic, pyrolysis oils and the likes.

The impurities present in the lipid material may be of various character or origin. Specifically, the impurities are such that they may be harmful in the process or they may render the material useless for its ultimate intended use. The impurities may be of metallic or polymeric origin such as elementary metals or for example phosphorous compounds. Specifically, the polymeric impurities that are removed may be e.g. commonly used plastics such a polyethylene (PE).

Notably, it has surprisingly found that the method as described herein is effective with respect to the time used to complete the purification process. Consequently, present invention provides for a purification method allowing a shorter time to purify the lipid material.

BRIEF DESCRIPTION OF THE DRAWINGS

FIG. 1*a* illustrates the side view (left hand) of the drum as well as the top-view (right hand). FIG. 1*b* illustrates a detailed side view of the settling drum and the various location wherein the samples and fractions are collected.

FIG. 2*a* illustrates the amount of polyethylene (PE), FIG. 2*b* illustrates the amount of solid material, FIG. 2*c* illustrates the amount of phosphor (P), FIG. 2*d* illustrates the amount of calcium (Ca), and FIG. 2*e* illustrates the amount of nitrogen (N).

DEFINITIONS

Figure 1A:
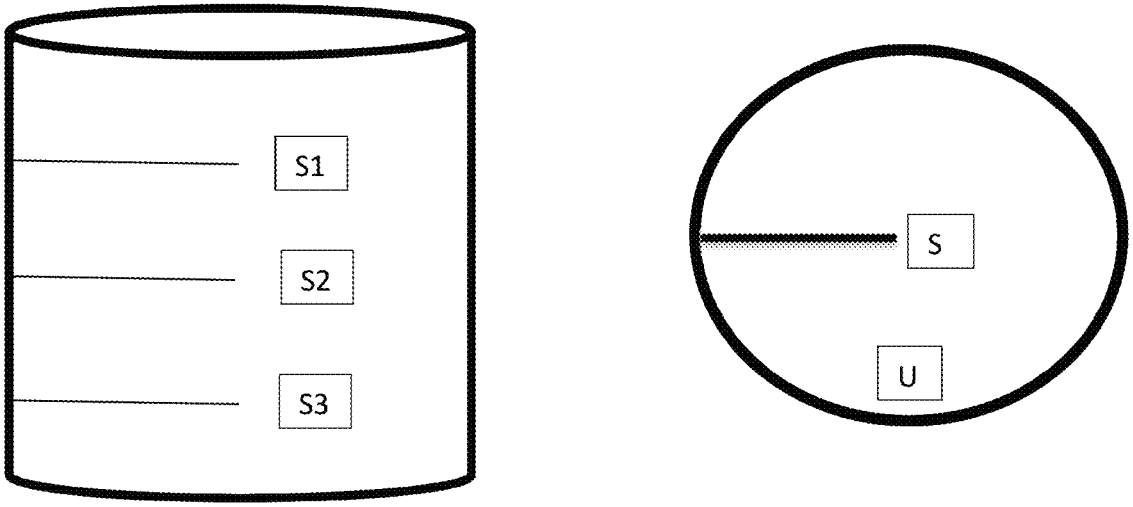
FIGS. 1*a*-1*b* illustrate the set-up of the AF settling test and the settling drum.

The following abbreviations will be used in the speciation

| | |
|---|---|
| PG | Phosphatidyl glycerols |
| PE | Phosphatidyl ethanolamines |
| PI | Phosphatidyl inositols |
| PC | Phosphatidyl cholines |
| PA | Phosphatidic acids |
| LPA | Lysophosphatidic acids |
| LPC | Lysophosphatidyl cholines |
| SM | Sphingomyeline |
| PHO | Phospholidids |
| PGLY | Phosphatidyl glycerols |
| AF | Animal fat |

DETAILED DESCRIPTION

Present invention relates to a method for purifying a lipid material. In one aspect, the invention relates to a method comprising the steps of:

a) storing the lipid material in a settling tank at elevated temperature, b) allowing the impurities to settle to the bottom of the settling tank to thereby form an oily sludge phase, c) separating the formed oily sludge phase from the rest of the lipid material, d) further processing the lipid material e) optionally purifying said separated oily sludge phase from impurities, and optionally f) returning the purified oil from the purifying step e) to said settling tank.

Specifically, the invention relates to a method for purifying lipid material, characterized in that the method comprises the following steps;

a) storing the lipid material in a settling tank at elevated temperature, b) allowing the impurities to settle to the bottom of the settling tank to thereby form an oily sludge phase, c) separating the formed oily sludge phase from the rest of the lipid material, d) further processing the lipid material e) purifying said separated oily sludge phase from impurities, and optionally f) returning the purified oil from the purifying step e) to said settling tank, wherein the method is characterized in that step e) comprises a heat treatment step comprising the steps of;

i. heating said oily sludge phase to a temperature of from about 150° C. to about 300° C., ii. adding polar solvent to said oily sludge phase for removal of impurities from oil phase such as e.g. phosphorus or calcium compounds, and iii. separating and recovering purified oil The lipid material to be used in present invention is a lipid material to be purified into a material that may serve as a source for fuel of any kind. The important factor is that the purified lipid material has to be of such a quality that it can serve as a fuel or be used in further processes such as e.g. catalytic cracking without containing levels of impurities that may e.g. jeopardize the full functionality of an engine or poisoning of catalysts or otherwise hampering of any further processes that the purified lipid material may be subjected to. Such further processes may be e.g. catalytic cracking, thermo-catalytic cracking, catalytic hydrotreatment, fluid catalytic cracking, catalytic ketonization, catalytic esterification, or catalytic dehydration. The purified lipid material may also be further processed into various chemicals, such as bulk chemicals (e.g. polymers, solvents, solvent components and lubricants) or specialty chemicals (e.g. cosmetics and pharmaceuticals).

In the art, there are various methods for purification of lipid material for the purposes mentioned herein. However, lipid material that contains high level of impurities may not be able or feasible to be purified by techniques known in the art such that the purified lipid material contains low levels of impurities allowing it to be used as a source of fuel. Present invention solves this problem by the method as disclosed herein, thereby allowing use of a lipid material that would normally be seen as uneconomical or unsuitable for purification.

Lipid material according to the invention may be, but is not limited to, any lipids containing phosphorous and/or metals and/or polymers such as e.g. various plastics. Examples of lipid materials are tall oil pitch or the residual bottom fraction from tall oil distillation processes, animal based oils or fats, vegetable based oils or fats such as e.g. sludge palm oil and used cooking oil or oil used in deep frying, microbial or algae oils, free fatty acids, used or spent lubrication oils or other types of waxes. Other examples of lipid material are plant oils, plant fats, animal fats and animal oils, algae, yeast and mould oils. It is to be understood that lipid material may be a mixture of any of the above mentioned examples of lipid materials. Suitable biological raw materials include rapeseed oil, canola oil, colza oil, tall oil, sunflower oil, soybean oil, hemp oil, olive oil, linseed oil, cottonseed oil, mustard oil, palm oil, *arachis* oil, castor oil, coconut oil, animal fats such as suet, tallow, blubber, recycled alimentary fats, starting materials produced by genetic engineering, and biological starting materials produced by microbes such as algae and bacteria.

Exemplified lipid material include, but is not limited to:

Tall oil pitch (TOP), residual bottom fraction from tall oil distillation process, Low quality animal fat (AF), not accepted for product quality (very high N, PE, metals, phosphorus contents etc.), Sludge palm oil (SPO) with very high iron content. SPOs are waste oils collected from water ponds located near palm oil mills, Used cooking oil (UCO), may contain high level of oligomers and chlorides The lipid material used in the process may also be fossil based, such as e.g. various oils used and produced by the oil industry. Non-limiting examples are various petroleum products such as e.g. fuel oils and gasoline (petrol). The term also encompasses all used products in either the refining process or e.g. used lubrication oils, waste plastic, pyrolysis oils and the likes.

These lipid materials need to be purified in order to lower the level of elements known to render the material useless for its ultimate intended use.

The impurities present in the lipid material may originate from the lipid material itself or the impurities may originate elsewhere, e.g. from the earlier processing of the lipid material. The present invention may be used for removal of any impurity that can be separated from the lipid material by settling.

The lipid material to be purified may contain impurities containing metals and phosphorus in the form of phospholipids, soaps or salts. Moreover, the lipid material may contain polymers and specifically polymers in the context of plastics. Notably such plastics may be e.g. polyethylene (PE). However, any plastic polymer may be removed according to the invention. Exemplary plastics may Bakelite, polystyrene, polyvinyl chloride, poly(methyl methacrylate), rubber or synthetic rubber, polyester, polyethylene terephthalate, polyvinylidene chloride, polypropylene, high impact polystyrene, polyamides, acrylonitrile butadiene styrene, polyethylene/acrylonitrile butadiene styrene, polycarbonate, polycarbonate/acrylonitrile butadiene styrene, polyurethanes. It is also to be understood that the term polymer may comprise a blend of different plastics and/or rubbers.

Metal impurities that may be present in the lipid material may be e.g. alkali metals or alkali earth metals, such as sodium or potassium salts or magnesium or calcium salts or any compounds of said metals. The impurities may also be in form of phosphates or sulphates, iron salts or organic salts, soaps or e.g. phospholipids.

Traditional techniques to remove impurities from lipids or fats consist of degumming and bleaching. In degumming impurities are removed by addition of acid and water and the separation of impurities is performed by gravitational separation by e.g. centrifugation. However, as noted in prior art, settling as part of a purification method is not considered feasible since this requires a large amount of time, typically in the range of several weeks such as e.g. more than 5 weeks.

Present invention has the benefit of using a simple method comprising settling of the lipid material. Moreover, in the method according to the invention the lipid material may be purified as such without addition of any other material during the heat treatment. Thus present method provides for a simplified yet effective procedure which reduces the need for addition of other constituents or chemicals which may traditionally be needed when purifying similar material. Notably, the purification method can be completed within days.

The present invention provides improvements to the purification of lipid material by reducing the loss of material during purification and by improving the purity of the lipid material in the tank. The purified and separated oily sludge of the present invention may be returned to the setting tank thereby improving the overall purity of the lipid material in the tank. If the oily sludge is not purified and remains in the tank as such, the impurities remain in the settling tank increasing the total amount of impurities in the tank.

According to the invention, the process of purification takes place under heating. Specifically, according to the invention, the elevated temperature and settling in step a) and b) is such that the temperature is sufficiently high to allow the lipid material to be purified to become liquid. Thus the lipid material is to about 40° C. to about 120° C., such as e.g. about 50° C. to about 110° C., such as e.g. about 60° C., about 100° C., or about 40° C., about 50° C., about 60° C., about 70° C., about 80° C., about 90° C., about 100° C., about 110° C. or about 120° C.

The time during which the lipid material is heated and held at the desired temperature is about 5 hours to about 14 days, such as e.g. about 2 days to about 10 days, such as e.g. about 3 days to about 7 days, or about 10 hours, about 15 hours, about 1 day, about 2 days, about 3 days, about 4 days, about 5 days, about 6 days, or about 7 days.

Ideally the time during which the desired temperature is held is about 5 hours, about 10 hours, about 15 hours, about 1 day, about 2 days, about 3 days, about 4 days, about 5 days.

It should be noted that the settling process may be executed without any agitation or stirring. However, a slow agitation or stirring which does not hinder the settling may be executed.

After completion of the settling step b), the lipid material is separated from the formed oily sludge. This process may comprise decantation of the lipid material from the oily sludge which may form a separate phase with the lipid material.

The lipid material is then further processed in any process depending on the intended use of the lipid material. The lipid material may be further processed as such or after further purifications. Such processes are e.g. hydrotreatment or co-processing. The separated oily sludge may be further purified from any impurities. Thus, the further purification of the oily sludge may comprise any suitable method such as hydrolysis or e.g. filtration, centrifugation and/or other mechanical removal of particulate impurities from the oily sludge. This purification step as outlined in step d) of present invention may comprise heating as part of the purification step.

Overall, the purification of the oily sludge may entail a process comprising the steps of i. heating said oily sludge phase,
ii. adding solvent to said oily sludge phase for removal of impurities from oil phase such as e.g. phosphorus or calcium compounds, and
iii. separating and recovering purified oil.

The heating in step i) may be in the interval of from about 100° C. to about 350° C., such as e.g. about 150° C. to about 300° C., or about 170° C. to about 240° C., or about 200° C. to about 250° C., or about 180° C. to about 200° C. Preferably, the heating is in the interval of about 180° C. to about 200° C.

The solvent used in step ii) may be a polar or non-polar solvent. For example, polar solvent may be water or any other suitable polar solvent such as e.g. an alcohol such as e.g. methanol, iso-propanol or any combination thereof. Moreover, the polar solvent may be a combination of water with a suitable alcohol or mix of alcohols.

The purified oil may be further subjected to a filtration step as needed in order to remove any solid residues such as e.g. metal impurities formed in step ii). However any suitable separation method may be employed such as e.g. centrifugation and/or mechanical removal. It is also to be understood that a combination of the mentioned techniques for removal of impurities may be employed.

The purified and separated oil may also be subjected to a bleaching step.

Optionally, the purified and separated recovered oil, may be recycled back to the settling tank in step a) of the invention.

The impurities that may be removed by the method of the invention are as mentioned herein. Notably, the impurities are one or more of polyethylene, calcium salts, sodium or phosphorous salts of any kind.

With respect to polyethylene, the method of the invention removes at least about 90%, such as e.g. at least about 95%, such as e.g. at least about 97%, such as e.g. at least about 98%, such as e.g. at least about 99% of the original content of polyethylene in the lipid material. Consequently, the lipid material purified by the method of present invention has a polyethylene content of below about 50 ppm, such as e.g. below about 30 ppm, such as e.g. below about 20 ppm, such as e.g. below about 15 ppm, such as e.g. below about 10 ppm, such as e.g. below about 5 ppm. The same holds true for any of the herein mentioned plastics.

Thus the method according to the invention provides for a purified lipid material that is suitable for further use such as e.g. a source of fuel or chemicals, such as bulk chemicals or specialty chemicals.

In one aspect, the invention relates to the following items:

1. A method for purifying lipid material, characterized in that the method comprises the following steps;
   a) storing the lipid material in a settling tank at elevated temperature,
   b) allowing the impurities to settle to the bottom of the settling tank to thereby form an oily sludge phase,
   c) separating the formed oily sludge phase from the rest of the lipid material,
   d) further processing the lipid material
   e) optionally purifying said separated oily sludge phase from impurities, and optionally
   f) returning the purified oil from the purifying step d) to said settling tank.
2. The method according to item 1, characterized in the said elevated temperature in step a) is from about 40° C. to about 120° C.
3. The method according to any of the preceding items, wherein settling in the settling tank takes place without any form of stirring.
4. The method according to any of the preceding items, wherein the time during which the impurities in the lipid material is allowed to settle to the bottom of the settling tank is from e.g. about 5 hours, about 10 hours, about 15 hours, about 1 day, about 2 days, about 3 days, about 4 days, about 5 days.
5. The method according to any of the preceding items, wherein the lipid material is originating from biological material.
6. The method according to item 5, wherein the lipid material is selected from e.g. used cooking oil, vegetable oils or any kind or animal fats of any kind or mixtures thereof.
7. The method according to any of the preceding items, wherein the lipid material is selected from any fossil based oil or product, such as e.g. various oils used and produced by the oil industry, such as e.g. fuel oils and gasoline (petrol), including all used products in either the refining process, or e.g. used lubrication oils, waste plastic pyrolysis oils and the likes.
8. The method according to item 1 or 2, characterized in that said separation step in step c) comprises phase separation such as e.g. by decantation, whereby the lipid material is separated from the oily sludge.
9. The method according to item 1 or 2, characterized in that said purifying step d) comprises filtration, centrifugation and/or other mechanical removal of particulate impurities from the oily sludge.
10. The method according to any of the previous items, characterized in that said purifying step d) comprises a heat treatment step.
11. The method according to item 10, characterized in that said heat treatment step in step d) comprises the steps of
    i. heating said oily sludge phase to a temperature of from about 150° C. to about 300° C.,
    ii. adding polar solvent to said oily sludge phase for removal of impurities from oil phase such as e.g. phosphorus or calcium compounds, and
    iii. separating and recovering purified oil.
12. The method according to item 11, wherein the heating in step i) is performed during a period of about 5 to about 60 minutes, such as e.g. about 10 minutes to about 50 minutes, such as e.g. about 15 minutes to about 40 minutes, such as e.g. about 20 minutes to about 30 minutes.
13. The method according to item 11 or 12, wherein the heating in step i) is about 170° C. to about 240° C., preferably about 180° C. to about 200° C.
14. The method according to item 11, 12 or 13, wherein the polar solvent is water, methanol or ethanol or any combination thereof.
15. The method according to item 11, wherein the recovered purified oil in step ii) is subjected to a filtration and/or centrifugation and/or mechanical removal to remove impurities present in the sludge.
16. The method according to any of the preceding items, wherein the separated and recovered purified oil is further subjected to a bleaching step.
17. The method according to any of the preceding items, wherein impurities are one or more of polyethylene, calcium salts, sodium salts or phosphorous salts.
18. The method according to any of the preceding items wherein at least about 90%, such as e.g. at least about 95%, such as e.g. at least about 97%, such as e.g. at least about 98%, such as e.g. at least about 99% of the original content of polyethylene in the lipid material is removed.
19. A purified lipid material obtainable by the method according to any of items 1-15, characterized in that the purified lipid material has a polyethylene content of below about 50 ppm, such as e.g. below about 30 ppm, such as e.g. below about 20 ppm, such as e.g. below about 15 ppm, such as e.g. below about 10 ppm, such as e.g. below about 5 ppm.
20. Use of a purified lipid material obtainable by the method according to any of the preceding items, as a source of fuel or chemicals, such as e.g. bulk chemicals or specialty chemicals.

EXAMPLES

Example 1

Settling Test Procedure

The target of the settling test was to get understanding and follow settling of polyethylene and other impurities in the liquid animal fat (AF).

Figure 1B:
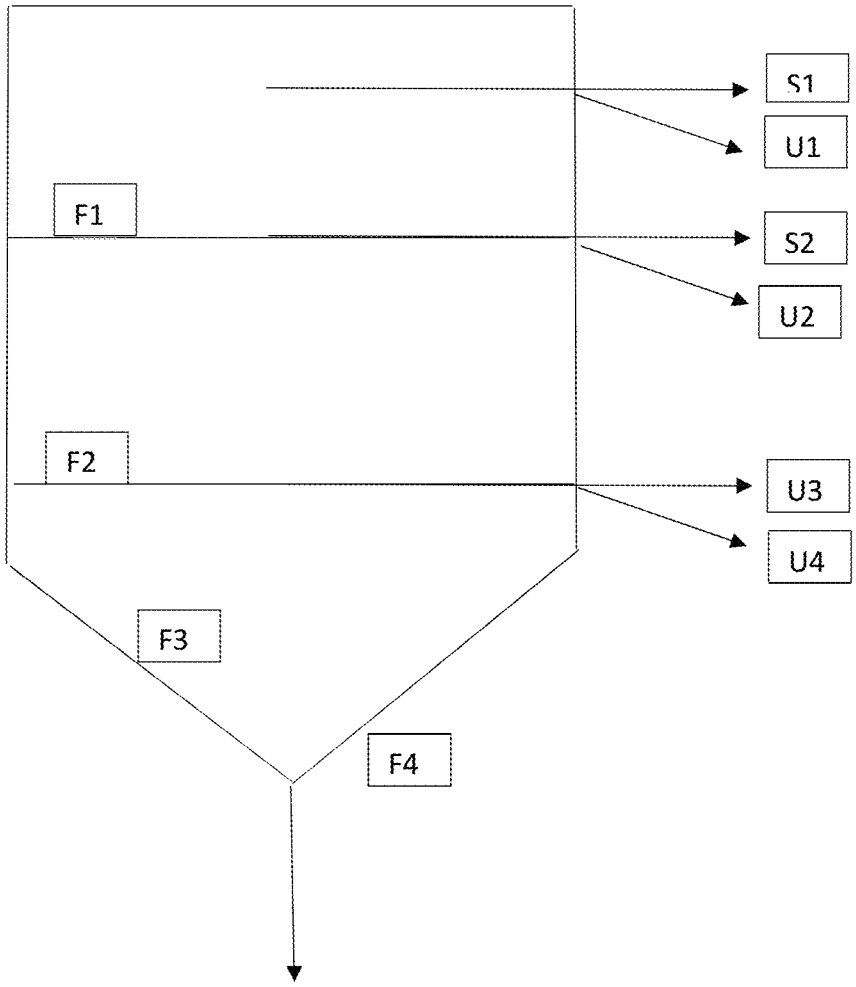
Figure 2A:
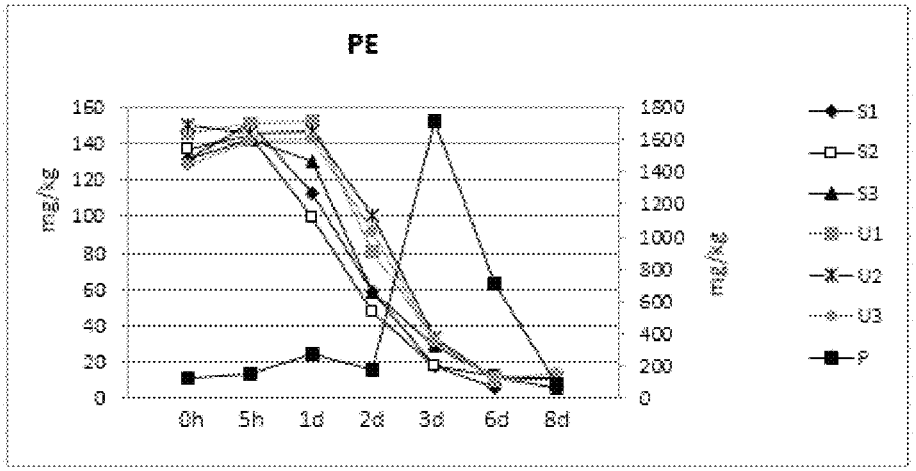
FIGS. 2*a*-2*e* illustrate the various amounts of impurities present in the samples taken from the purification process according to the invention in relation to purification time.
Figure 2B:
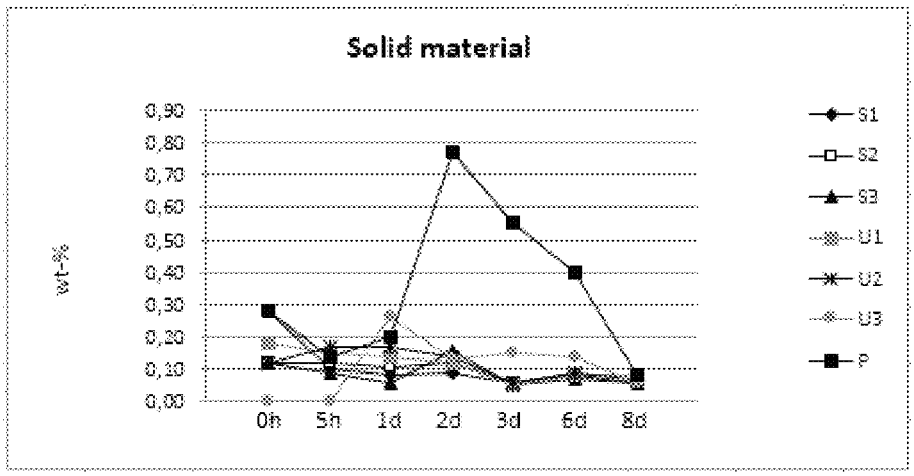
Figure 2C:
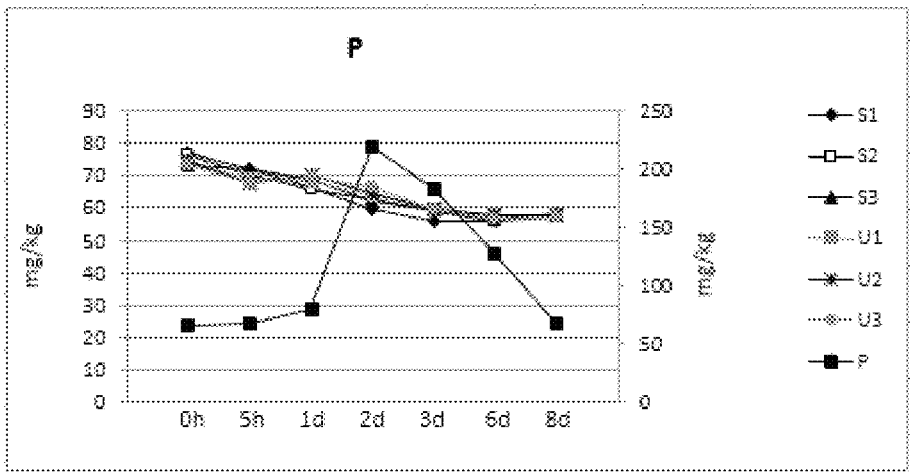
Figure 2D:
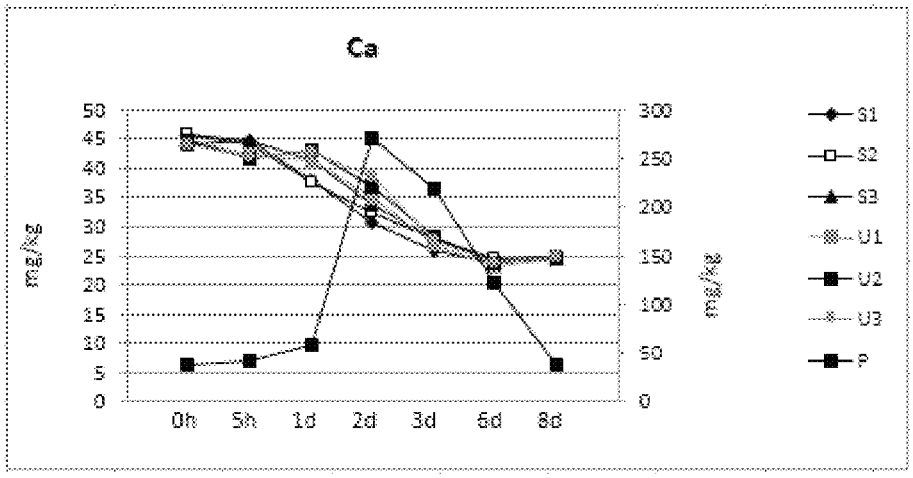
Figure 2E:
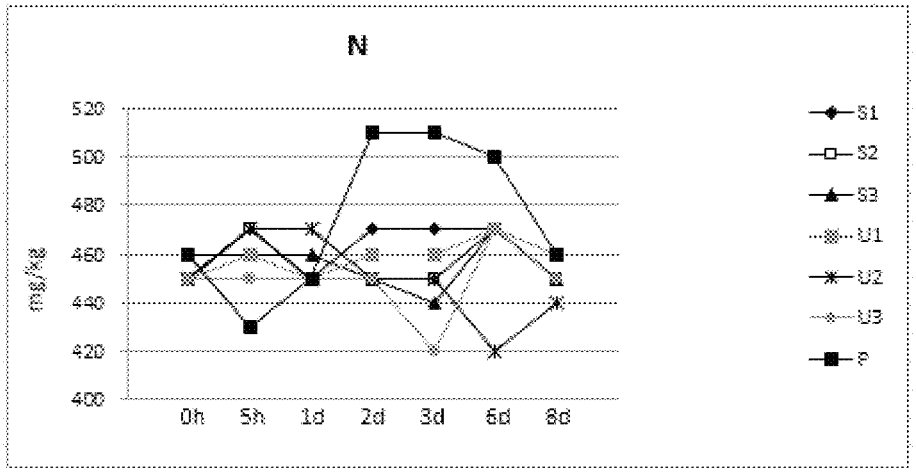

The test set up included 200 l drum with homogenized animal fat. The drum was equipped with 6 sampling points, 2 in the upper part (1), 2 in the middle part (2) and 2 in the bottom (3). Samples were taken from each level from the middle (S) and from the side (U) of the drum (cf. FIG. 1).

The AF was settled about 5 weeks at 60° C. without stirring. Samples were taken weekly and e.g. PE, P, N, metals, PE, solid material and particle counting were analyzed.

4 fractions were obtained while emptying the drum:

F1 Main product fat from the taps

F2 Remaining fat fat recovered with hand pump (after fat level went below lowest tap)

F3 Sludge mixture of fat/solid material poured from the drum

F4 Sediment solid material scraped from the bottom of the drum

The results showed excellent removal of PE and good removal of solid material, Ca and Si. Fair good removal of P and Mg was also observed (table 1).

TABLE 1

Reduction of the impurities in animal fat after 5 weeks settling.

| | Reduction (%) |
|---|---|
| N | −1.0 |
| PE | >94.2 |
| Fe | −9.1 |
| Na | −14.6 |
| Si | 24.3 |
| Ca | 40.1 |
| Mg | 15.0 |
| P | 17.1 |
| Solid material | 25.0 |

Example 2

Settling Test 2

The test set up included a 200 l acid resistant drum with about 140 kg homogenized animal fat. Before the test animal fat was melted and homogenized at 60° C. Samples (1000 ml) were taken from seven sampling points: two in the upper part (1), two in the middle part (2) and two in the bottom (3). Samples from each of these levels were taken from the middle (S) and from the side (U) of the drum. One sample was taken from the bottom of the drum. The animal fat was settled at 60° C. in heating chamber without stirring for about 1 week. The samples were taken at zero point, after 5 h and after 1, 2, 3, 6 and 8 days.

P, N, metals, PE, $H_2O$ and solid material were analyzed from the samples.

1000 ml samples were taken from each sampling point. On day 8 the oil level dropped below S1 and U1 taps and sample U1 was only recovered. (cf. FIG. 1*b*)

3 fractions were obtained while emptying the drum:

| | | |
|---|---|---|
| F1 | 42 kg | fat from below sampling tap 2 |
| F2 | 47 kg | fat recovered from sampling tap 3 |
| F3 | 50 kg | fat recovered from the bottom sampling tap (P) |
| F4 | | No sediment obtained |

Results of Settling Test 2

The results after settling for 8 days were compared to the average results of 0 days. The bottom samples were not taken into account. Excellent removal of PE, good removal of solid material, Ca, Si and Fe and fairly good removal of P and Mg was observed (Table 2).

TABLE 2

| | Reduction (%) |
|---|---|
| N | −1 |
| PE | 93 |
| P | 23 |
| Al | 0 |
| Fe | 38 |
| Na | −4 |
| Si | 41 |
| Ca | 45 |
| Mg | 28 |
| Mn | 0 |
| Solid material | 63 |

Excellent removal of PE (93 wt-%), good removal of solid material (63 wt-%) and metals like Ca (45 wt-%), Si and Fe, fairly good removal of P (23 wt-%) and Mg was observed. PE concentration was higher on the surface part of the drum than inside the drum. PE, as well as solid material, P and metals are concentrated to the bottom right after 2nd day, dramatically on 3rd day and reduces after that. Nearly all PE was removed on day 8. See FIGS. 2*a*-2*e* for the respective results in a graphical representation.

Example 3

Settling Test No 3

Target was to settle animal fat (AF) with continuous take-off from bottom valve. The test was performed in about 200 l acid resistant feed tank with two sampling points, one in the bottom and one from the center of the tank. The tank was equipped with circulating heating cable and other outer parts were sealed. 6×30 l canisters of animal fat were melted in heating chamber at 60° C. and removed to the feed tank by transfer (feed) pump. The fat was then homogenized by recycling it from the bottom to the top with transfer pump for 1.5 h and with bubbling nitrogen from the bottom. After this the fat settled for 6 days without stirring at 60° C. Used settling temperature was measured from the side and from the inside of the vessel. The melted fat was continuously drained from the bottom valve and the prominent pump was used to keep the flow constant (~0.8 ml/min) during the settling. Sampling times were: zero point, after 5 h, 1, 2, 3 and 6 days.

P, N, metals, PE and solid material were analyzed. Results present the average of each sampling time. Additionally phospholipids and $H_2O$ from the simulation samples.

TABLE 3

Analysis results from samples taken from the center of the vessel

| | | | 0 point, bottom | 0-5 h, bottom | 5-24 h, bottom | 24-48 h, bottom | 48-72 h, bottom | 72-144 h, bottom |
|---|---|---|---|---|---|---|---|---|
| | Time | Min | 0 | 300 | 1157 | 1445 | 1525 | |
| | Flow | g/min | 0 | 0.91 | 0.62 | 0.74 | 0.75 | |
| | Sample | g | 1826 | 272.1 | 720.9 | 1071 | 1140 | |
| ISO 6656 | PE Nofalab | mg/kg | 141 | 109 | 781 | 2155 | 712 | 90 |
| ISO 6656 | PE Neste oil | wt-ppm | nd | nd | nd | nd | 949 | 861 |
| ASTMD 4629 | N | mg/kg | 470 | 470 | 500 | 550 | 490 | 460 |
| ENISO 12937 | H2O | mg/kg | 850 | nd | nd | nd | nd | 390 |
| ISO 663 | Solid material | wt-% | 0.09 | 0.1 | 0.42 | 0.67 | 0.26 | 0.08 |
| ASTMD 5185 | Al | mg/kg | <0.3 | <0.3 | <0.3 | <0.3 | 0.3 | 0.3 |

TABLE 3-continued

| Analysis results from samples taken from the center of the vessel | | | 0 point, bottom | 0-5 h, bottom | 5-24 h, bottom | 24-48 h, bottom | 48-72 h, bottom | 72-144 h, bottom |
|---|---|---|---|---|---|---|---|---|
| ASTMD 5185 | Fe | mg/kg | 1.3 | 1.7 | 3.4 | 8.5 | 3.2 | 1.3 |
| ASTMD 5185 | Na | mg/kg | 60 | 58.1 | 64 | 60.2 | 60.8 | 54.8 |
| ASTMD 5185 | Si | mg/kg | 0.9 | 6.4 | 3.7 | 5.5 | 2.7 | 0.9 |
| ASTMD 5185 | Ca | mg/kg | 40.2 | 40.1 | 116 | 297 | 109 | 36.7 |
| ASTMD 5185 | Mg | mg/kg | 4.3 | 4.3 | 9.4 | 19 | 8.2 | 4 |
| ASTMD 5185 | P | mg/kg | 65.9 | 64.9 | 104 | 239 | 114 | 64.3 |
| ASTMD 5185 | Mn | mg/kg | <0.3 | <0.3 | <0.3 | 0.4 | <0.3 | <0.3 |

TABLE 4

| Analysis results from samples taken from the centre of the vessel. | | | 0 point, bottom | 0-5 h, bottom | 5-24 h, bottom | 24-48 h, bottom | 48-72 h, bottom | 72-144 h, bottom |
|---|---|---|---|---|---|---|---|---|
| | Time | Min | 0 | 300 | 1157 | 1445 | 1525 | |
| | Flow | g/min | 0 | 0.91 | 0.62 | 0.74 | 0.75 | |
| | Sample | g | 1872 | 1818 | 1172 | 1728 | 1735 | |
| ISO 6656 | PE Nofalab | mg/kg | 132 | 121 | 101 | 6 | <1 | 3 |
| ISO 6656 | PE Neste oil | wt-ppm | 176 | nd | nd | nd | nd | 16 |
| ASTMD 4629 | N | mg/kg | 470 | 460 | 470 | 470 | 460 | 460 |
| ENISO 12937 | H2O | mg/kg | 880 | nd | nd | nd | nd | 380 |
| ISO 663 | Solid material | wt-% | 0.12 | 0.1 | 0.11 | 0.08 | 0.07 | 0.06 |
| ASTMD 5185 | Al | mg/kg | <0.3 | <0.3 | <0.3 | <0.3 | 0.3 | 0.3 |
| ASTMD 5185 | Fe | mg/kg | 1.3 | 1.3 | 1.3 | 1.1 | 1 | 1 |
| ASTMD 5185 | Na | mg/kg | 56.7 | 57.3 | 57.3 | 53.4 | 52.9 | 53.7 |
| ASTMD 5185 | Si | mg/kg | 0.9 | 0.9 | 1 | 0.8 | 0.7 | 0.7 |
| ASTMD 5185 | Ca | mg/kg | 40.1 | 40 | 39.1 | 30.4 | 27.6 | 26.2 |
| ASTMD 5185 | Mg | mg/kg | 4.3 | 4.2 | 4.1 | 3.7 | 3.5 | 3.5 |
| ASTMD 5185 | P | mg/kg | 67.5 | 64.5 | 64.5 | 61.8 | 57.5 | 57.4 |
| ASTMD 5185 | Mn | mg/kg | <0.3 | <0.3 | <0.3 | <0.3 | <0.3 | <0.3 |

Excellent removal for PE and good removal of solid material by settling was observed. Fairly good removal of Ca, Si, Fe, Mg and P was observed. PE, as well as solid material, P and metals were concentrated to the bottom between 1st and 3rd day.

Example 4

Bleaching of Settled AF

Figure 3:
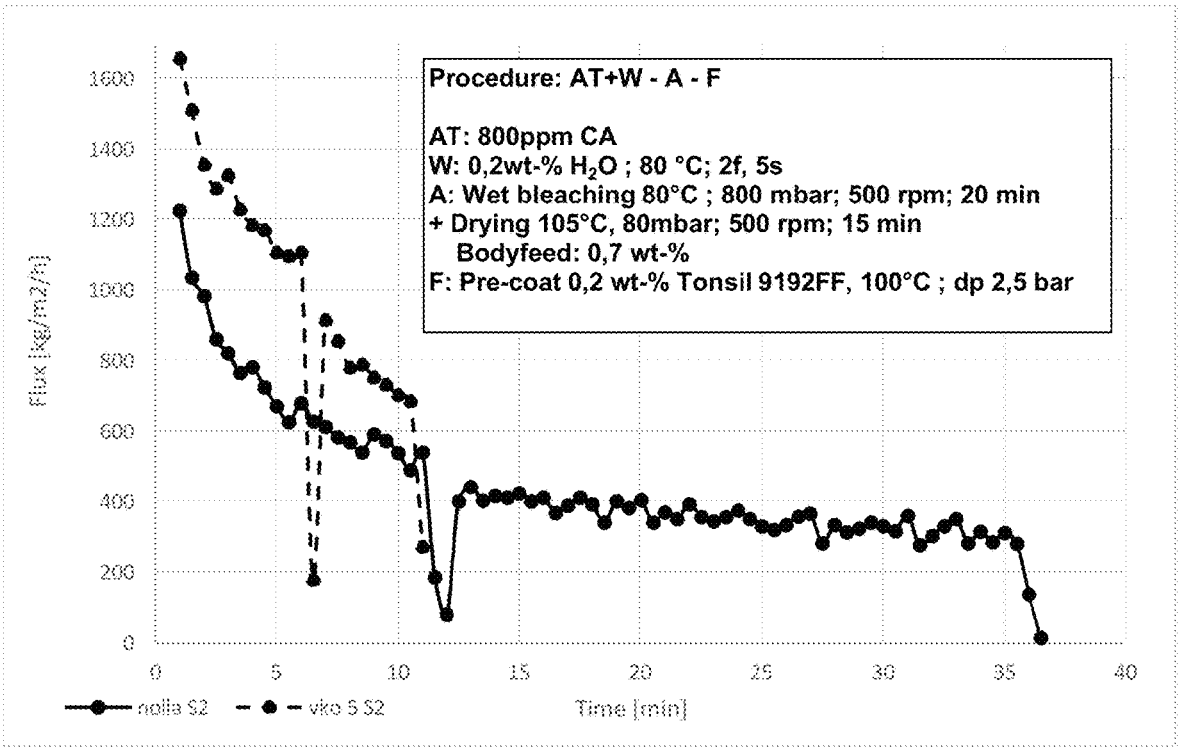
FIG. 3 illustrates the bleaching flux of animal fat at week 0 ("nolla") and week 5 ("vko 5"), samples taken from the middle of the settling vessel.

The bleaching flux of settled animal fat from Example 1 (sample from the middle of the settling vessel after 5 weeks) was improved compared to the original feed. The fat purification result was similar in both cases, however, the settled fat had <10 ppm PE (Ser. No. 02/995,810) compared to 17 ppm in bleached original feed (Ser. No. 02/932,479), cf. FIG. 3

Example 5

Treatment of Sludge

The sludge fraction of Example 1 was analyzed to contain an increased amount of phosphorus, metals and polyethylene (Table 5). However, this fraction contains also a large amount of oil, which could be taken back to the process after some treatment.

TABLE 5

Impurities in feed animal fat (0 weeks settling), sample from the middle of the settling vessel and sludge (5 weeks settling) from settling test.

| (mg/kg) | Feed | Sample S2 (5 weeks) | Sludge (5 weeks) |
|---|---|---|---|
| Oili | 02932411 | 02949755 | 02965160 |
| Fe | 1.1 | 1.3 | 13.5 |
| Na | 53.4 | 57.5 | 123 |
| Ca | 42 | 22.9 | 535 |
| Mg | 4.4 | 3.7 | 30.2 |
| P | 67 | 52.4 | 412 |
| Zn | 1 | — | — |
| N | 480 | 500 | 500 |
| PE | 166 | <10 | 5409 |
| PHO | 595 | 554 | 987 |

The sludge was treated in the following ways:

The sludge was treated by acid degumming which was able to remove large amounts of impurities (sample 02965166), however, not all polyethylene, which resulted in problems in the following bleaching test. Only ca. 50 g could be filtered in the Dahlman device before the filter was clogged (sample 02965844). The rest of the fat was therefore centrifuged after adsorption treatment instead of Dahlman filtration (sample 02967121) but PE is not removed fully in centrifugation. Results are presented in Table 6.

TABLE 6

Sludge treated with acid degumming followed by bleaching.

| | Feed sludge | AT-W-C 1000 ppm ca + 3% water/70 C. (PEB) | AT-W-C + AT-W-A-F 800 ppm ca + 0.2% water + 0.7% Tonsil (PEB) | AT-W-C + AT-W-A-C 800 ppm ca + 0.2% water + 0.7% Tonsil (PEB) |
|---|---|---|---|---|
| Oili | 02965160 | 02965166 | 02965844 | 02967121 |
| Fe | 13.5 | 0.7 | <0.1 | — |
| Na | 123 | 2.4 | <1 | |
| Ca | 535 | 17.6 | 0.8 | |
| Mg | 30.2 | 1.4 | <0.3 | |
| P | 412 | 30.6 | 3.8 | |
| N | 500 | 380 | 350 | |
| PE | 5409 | 1100 | N.A. | 469 |

Filtration

Filtration has been effective for PE removal of the feed animal fat (<1-2 ppm PE in samples), therefore this could be a possible treatment for the sludge in order not to clog the bleaching unit.

Filtration of the sludge was possible through a 2 μm and 0.45 μm filter paper. A large amount of brown precipitate was collecting on the 2 μm paper. The large amount of precipitate made the filtration quite slow.

Heat treating (in a pressure reactor 240° C./30 min) the sludge resulted in somewhat faster filtration. The precipitate was here also collecting on the 2 μm paper.

The amount of precipitate was in both cases around 3.5% of the original sludge, hence 96.5% of the sludge could be further taken back to e.g. bleaching.

It seems like settling removes phosphates from the original feed, however, not as effectively phospholipids. Also protein and polyethylene is found in the precipitate collected on the filter. The precipitate of the heat treated sludge did not contain protein and neither any phospholipid, which have been degraded by heating.

TABLE 7

Analysis results of precipitates collected on filter paper.

| | Precipitate from filtration of original sludge | Precipitate from filtration of Heat treated sludge |
|---|---|---|
| Oili | 02996372 | 02996373 |
| Precipitate on filter (% of original sludge) | 3.2 | 3.7 |

TABLE 7-continued

Analysis results of precipitates collected on filter paper.

| | Precipitate from filtration of original sludge | Precipitate from filtration of Heat treated sludge |
|---|---|---|
| IR | A lot of calcium phosphate. Quite a lot of protein and polyethylene (however, masked by long chains of glycerides). | A lot of calcium phosphate (however, less than in orig. sludge precipitate). No protein. Quite a lot of polyethylene (however, masked by long chains of glycerides). |
| EDS | C 56-84%, O 19-30%, Ca 3%, P 2%, Na < 1%, Mg < 1% ja K < 1%. | C 55-82%, O 21-31%, Ca 3%, P 2%, Na < 1%, Mg < 1%, K < 1% and Zn < 1%. |
| PGLY (mg/kg) | <0.5 | <0.5 |
| PE (mg/kg) | <0.5 | <0.5 |
| PI (mg/kg) | 1040 | <0.5 |
| PC (mg/kg) | 500 | <0.5 |
| PA (mg/kg) | 200 | <0.5 |
| LPA (mg/kg) | 1600 | <0.5 |
| LPC (mg/kg) | 1200 | <0.5 |
| SM (mg/kg) | 1000 | <0.5 |
| PHO (mg/kg) | 5520 | <0.5 |
| other PHO (mg/kg) | 480 | <0.5 |
| phospholipids of total P (PHO/P) % | 1.2* | <0.5 |
| Total fatty acids (GC) | 57 | 75 |

*Calculated based on 4.3% P in PHO, P in sample based on EDS-analysis.
(EDS = energy dispersive spectrometry).

Results for the filtered oil samples are presented in Table 8. Filtration could remove more sodium, phosphorus and zinc from the heat treated sludge than from the original. Polyethylene was unfortunately not analyzed because of too small sample size.

Figure 4:
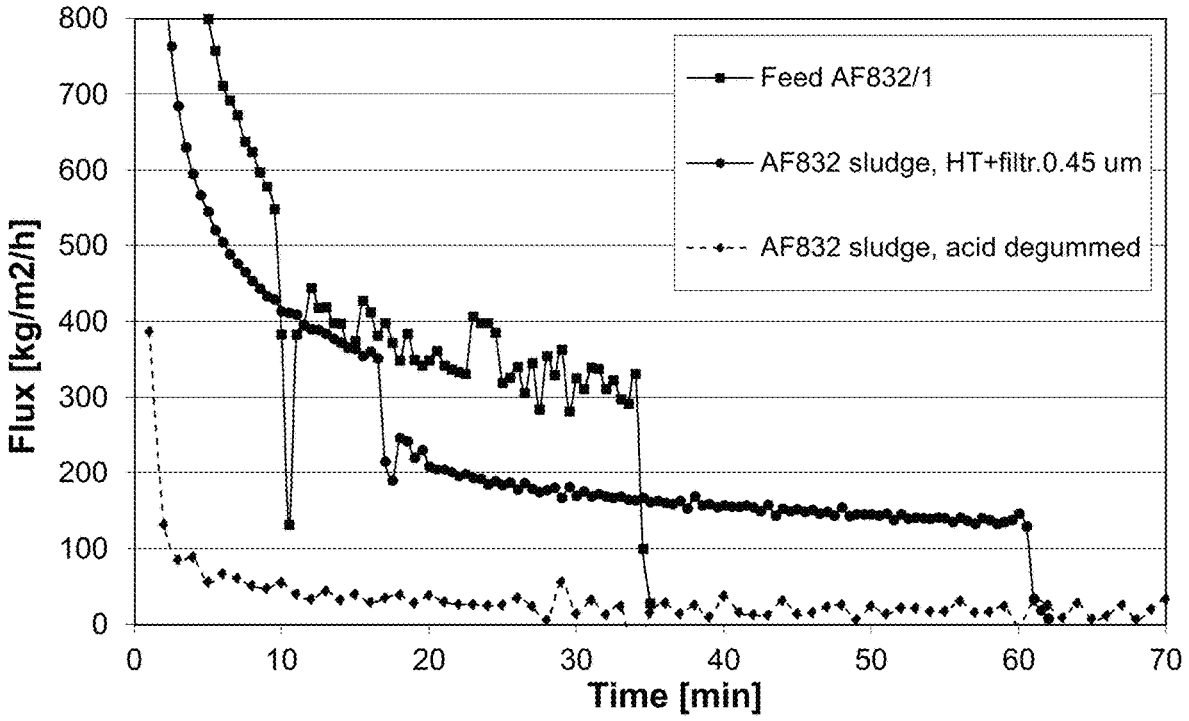
FIG. 4 illustrates the bleaching flux of sludge (acid degummed), sludge (heat treated and filtered) and original AF832 feed.
Figure 5:
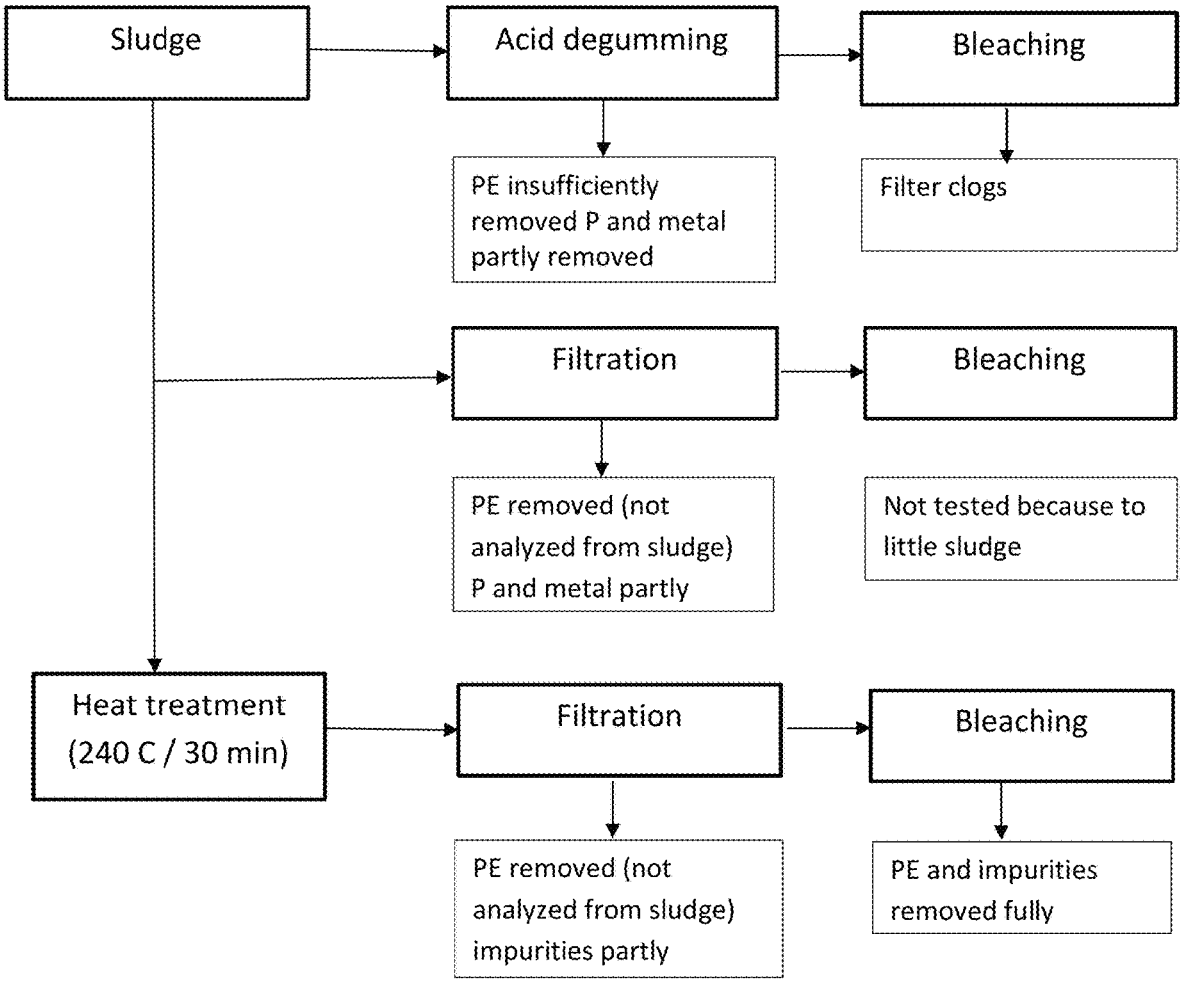
FIG. 5 illustrates the flow scheme of the acid degumming and bleaching process.

Bleaching of the heat treated and filtered sludge could remove all metals and only 1.2 ppm P remained after Dahlman filtration (no polishing) (Table 8). The bleaching flux is presented in FIG. 4.

TABLE 8

Filtration of original and heat treated sludge.

| | Feed sludge | Heat treatment | Filtration 0.45 um/85 C. | Filtration 0.45 um + AT-W-A-F 800 ppm ca + 0.2% water + 0.7% Tonsil (filtr. 100 C.) |
|---|---|---|---|---|
| Oili | 2965160 | No heat | 02981183 | — |
| Fe | 13.5 | treatment | 2.2 | |
| Na | 123 | (original | 59.7 | |
| Ca | 535 | sludge) | 21.7 | |
| Mg | 30.2 | | 3.6 | |
| P | 412 | | 52.4 | |
| Zn | — | | 59.1 | |
| N | 500 | | 390 | |
| PE | 5409 | | N.A. | |
| Oili | 2965160 | Heat | 2981181 | 2996346 |
| Fe | 13.5 | treatment in | 1 | <0.1 |
| Na | 123 | Parr 240 | 23.1 | <1 |
| Ca | 535 | C./30 min | 26 | <0.3 |
| Mg | 30.2 | | 3.1 | <0.3 |
| P | 412 | | 24.4 | 1.2 |
| Zn | — | | 7 | <0.5 |
| N | 500 | | 410 | 430 |
| PE | 5409 | | N.A. | <1 |

Settling of AF containing PE can be used to remove >97% PE and additionally some metals, especially calcium, and phosphorus. The bleaching flux of the fat improved with settling of PE and part of the impurities.

The settled sludge can thereafter be treated by filtration (or heat treatment and filtration) to remove large amounts of calcium phosphate and polyethylene which it contains. Ca. 96% fat can be separated from the sludge which can be taken back to the process and purified by e.g. bleaching. Thus, sludge heat treatment followed by filtration and bleaching results in pure fat, containing only 1.2 ppm P and no PE.

The invention claimed is:

1. A method for purifying lipid material, wherein the method comprises:

a) storing the lipid material in a settling tank at elevated temperature;

b) allowing impurities to settle to a bottom of the settling tank to thereby form an oily sludge phase;

c) separating the formed oily sludge phase from a remainder of the lipid material, d) further processing the lipid material;

e) purifying said separated oily sludge phase from impurities; and optionally f) returning purified oil from the purifying step e) to said settling tank, wherein the method in step e) includes a heat treatment step which includes:

i. heating said oily sludge phase to a temperature of from about 150° C. to about 300° C.;

ii. adding polar solvent to said oily sludge phase for removal of impurities from oil phase; and iii. separating and recovering purified oil;

wherein said elevated temperature in step a) is from about 40° C. to about 120° C., and wherein settling in the settling tank takes place without any form of stirring.

2. The method according to claim 1, wherein a time during which the impurities in the lipid material is allowed to settle to the bottom of the settling tank is selected to be from about 5 hours, about 10 hours, about 15 hours, about 1 day, about 2 days, about 3 days, about 4 days, or about 5 days.

3. The method according to claim 1, wherein the lipid material is originated from biological material.

4. The method according to claim 1, wherein the lipid material is selected from used cooking oil, vegetable oils or any kind or animal fats of any kind or mixtures thereof.

5. The method according to claim 1, wherein the lipid material is selected from any fossil based oil or product, industrial oils used, fuel oils and gasoline (petrol), including all used products in either a refining process, or used lubrication oils, or waste plastic pyrolysis oils.

6. The method according to claim 1, wherein separating in step c) comprises:

phase separation by decantation, whereby the lipid material is separated from the oily sludge.

7. The method according to claim 1, wherein the heating in step i) is performed during a period of time which is selected to be about 5 to about 60 minutes, about 10 minutes to about 50 minutes, about 15 minutes to about 40 minutes, or about 20 minutes to about 30 minutes.

8. The method according to claim 1, wherein the heating in step i) is about 170° C. to about 240° C.

9. The method according to claim 1, wherein the polar solvent is water, methanol or ethanol or any combination thereof.

10. The method according to claim 1, wherein the recovered purified oil in step iii) is subjected to a filtration and/or centrifugation and/or mechanical removal to remove impurities present in the sludge.

11. The method according to claim 1, comprising:

bleaching the separated and recovered purified oil.

12. The method according to claim 1, wherein impurities are one or more of polyethylene, calcium salts, sodium salts or phosphorous salts.

13. The method according to claim 1, comprising:

removing at least about 90% of the original content of polyethylene in the lipid material.

14. The method according to claim 1, wherein the heating in step i) is to a temperature of about 180° C. to about 200° C.

15. The method according to claim 1, comprising:

removing at least about 95% of the original content of polyethylene in the lipid material.

16. The method according to claim 1, comprising:

removing at least about 97% of the original content of polyethylene in the lipid material.

17. The method according to claim 1, comprising:

removing at least about 98% of the original content of polyethylene in the lipid material.

18. The method according to claim 1, comprising:

removing at least about 99% of the original content of polyethylene in the lipid material.

* * * * *